US007387009B2

(12) United States Patent
Kane et al.

(10) Patent No.: US 7,387,009 B2
(45) Date of Patent: Jun. 17, 2008

(54) AUTOMATED BENDING MACHINE

(76) Inventors: Kevin Kane, 8763 Pinion Dr., Lake Worth, FL (US) 33467; David Kane, 12109 53rd Rd. N., Royal Palm Beach, FL (US) 33411

( * ) Notice: Subject to any disclaimer, the term of this patent is extended or adjusted under 35 U.S.C. 154(b) by 71 days.

(21) Appl. No.: 11/389,417

(22) Filed: Mar. 24, 2006

(65) Prior Publication Data

US 2006/0260377 A1 Nov. 23, 2006

Related U.S. Application Data

(60) Provisional application No. 60/665,096, filed on Mar. 24, 2005.

(51) Int. Cl.
*B21D 11/20* (2006.01)

(52) U.S. Cl. ..... 72/307

(58) Field of Classification Search ..... 72/294, 72/307, 319, 173–175
See application file for complete search history.

(56) References Cited

U.S. PATENT DOCUMENTS 1,512,002 A 10/1924 Kardong
4,049,026 A 9/1977 Del Fabro
4,097,632 A 6/1978 Minogue et al.
4,523,449 A 6/1985 Moriyama et al.
4,701,991 A 10/1987 Scheffer, Sr.
4,773,284 A 9/1988 Archer et al.
4,793,171 A 12/1988 Russell
4,944,176 A 7/1990 Glorieux et al.
5,243,844 A * 9/1993 Lisec ..... 72/168
5,367,902 A 11/1994 Kitabaashi et al.
5,377,516 A 1/1995 Lipari
5,456,099 A 10/1995 Lipari
5,461,893 A 10/1995 Tyler
5,669,261 A * 9/1997 Castren ..... 72/307
5,870,919 A 2/1999 Song
5,881,591 A * 3/1999 Ondracek ..... 72/14.9
6,003,358 A * 12/1999 Lipari et al. ..... 72/404
6,094,960 A 8/2000 Kane et al.
6,308,551 B1 * 10/2001 Park ..... 72/307

* cited by examiner

*Primary Examiner*—Daniel C Crane
(74) *Attorney, Agent, or Firm*—McHale & Slavin, P.A.

(57) ABSTRACT

The present invention is directed towards an automated bending device for bending a strip of material into a desired shape. Particularly towards an automated bending device for bending a strip of metal into at least one side panel used to form three-dimensional letters in signs.

2 Claims, 7 Drawing Sheets

AUTOMATED BENDING MACHINE

CROSS REFERENCE TO RELATED APPLICATION

The instant application claims benefit of provisional application No. 60/665,096, filed on Mar. 24, 2005, the content of which is herein incorporated by reference in its entirety.

FIELD OF THE INVENTION

This invention is directed towards an automated bending device for bending a strip of material into a desired shape; particularly towards an automated bending device for bending a strip of metal into at least one side panel used to form three-dimensional letters used in signs.

BACKGROUND OF THE INVENTION

Lighted signs are commonly used as a tool for identifying stores or other types of businesses. Often, these signs are formed from a series of discrete, three-dimensional letters. These letters, commonly known as a "channel letters," typically include congruent front and/or back panels spaced apart by a rigid spacer band extending perpendicularly between the panel perimeters. The spacer band maintains the panels in a parallel, spaced-apart orientation. With this arrangement, the letters may be fitted with an internal light source and lit from within. Usually, at least the front panel of these letters is transparent or translucent, allowing light from within the letter to pass through the front panel, thereby illuminating the letter to passerby.

Various methods have been developed to efficiently and accurately produce these letters. The front and rear panels may be formed, for example, by cutting around a template or stencil. The letter may also be stamped from large sheets of material. Corresponding spacing strips, however, are harder to produce. Typically, the letter panel spacing strips are formed by cutting a strip of metal sheet stock to a predetermined length appropriate for the desired letter. Then the strip is bent at a series of key locations to produce a bounded region that will follow the contours of the selected letter. The strips also often include edge flanges that increase structural integrity. Collectively, these flanges also form surfaces that allow secure attachment of panels to the spacing strip. Additionally, the flanges maybe used to secure the completed letter to a wall or other mounting surface.

DESCRIPTION OF THE PRIOR ART

There have been numerous machines designed to automatically form three-dimensional channel letters from strips of material.

For example, U.S. Pat. No. 5,881,591 to Carl Ondracek, discloses a machine comprising a feed assembly that moves the strip of material along a material feed path, a notching station that notches the edge of the material where necessary for the purpose of forming flanges in the material and bending the material, a flange forming station that forms the flanges on the edge of the material, and a bending assembly that bend the strip of material into the desired form, with a single bending arm moving from one side to the other as necessary. The material is cut at a cutting station immediate preceding the bending assembly. Similarly, WO 01/21336 also to Carl Ondracek, discloses a bending assembly that includes a cutting assembly operatively connected thereto.

The instant inventive device differs from the aforementioned references in that it uses two different bending rollers, that is, a "sharp" bend roller and "round" bend roller which allow for "roll-forming" of the material forming the radius portions of channel letters, wherein the prior art uses "brake-press" forming to incrementally to form multiple linear bends that combine to form a radius or semi-radius.

SUMMARY OF THE INVENTION

The present invention relates to an automated strip-bending device used to bend a strip of metal material at a series of predetermined locations to produce the side panel found in three-dimensional signs. The automated bending device includes a table with a surface upon which at least two opposed drive rollers are rotatably connected to. The drive rollers create a feed path for the material therebetween.

At least one pair of holding plates are located downstream the drive rollers along the feed path and serve to maintain the strip of material in a substantially perpendicular direction relative to the surface of the table. The holding plates include left and right side sharp bending dies formed at their first ends. These sharp dies act as both a means to guide the strip of material along the feed path and provide a contact surface against which a bending assembly acts to produce a "sharp" bend on the material strip.

The bending assembly includes two different bending rollers, a "sharp" bend roller and "round" bend roller for creating a sharp angle or curve, respectively, at predetermined locations along the strip of material.

The bending assembly also includes a pair of independently controlled round rolling arms connected to the surface of the table at one first end, wherein the second end of the round rolling arms align on either side of the feed path, preferably, upstream from the sharp bending dies of the holding plates when moved to a first "closed" position. These rolling arms move along an arcuate path above the surface of the table to a second fully "open" position, such that the round rolling arms are substantially clear from the material as it advances down the feed path. These rolling arms provide a cylindrical, rounded die contact surface at their second ends upon which the round bending roller acts against to produce a "curved" bend as the material strip is continuously fed through the device.

Accordingly, it is the principle objective of the instant invention to teach a device able to engender vastly varying shapes on a strip of material using at least one sharp bending roller, at least a pair of sharp bending dies, at least one round bending roller, at least a pair of round bending dies and at least one of a pair of round rolling arms or combinations thereof.

It is a further objective of the instant invention to provide a bending device that is able to bend strips of material with or without a flange, or notched with a flange.

Another objective of the instant invention is to provide a portable bending assembly that works to bend and/or create angles in the strip of material while the material is fed in a continuous manner, without the need to stop the advancement of the material during the bending process.

Still yet another objective of the present invention is to provide an automated device that may be used with material strips of various widths and heights.

Yet another objective of the instant invention is to teach a device that uses a plurality of bending rollers to provide greater flexibility to the automated device.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENTS

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representative basis for teaching one skilled in the art to employ the present invention in virtually any appropriately detailed structure.

Figure 1:
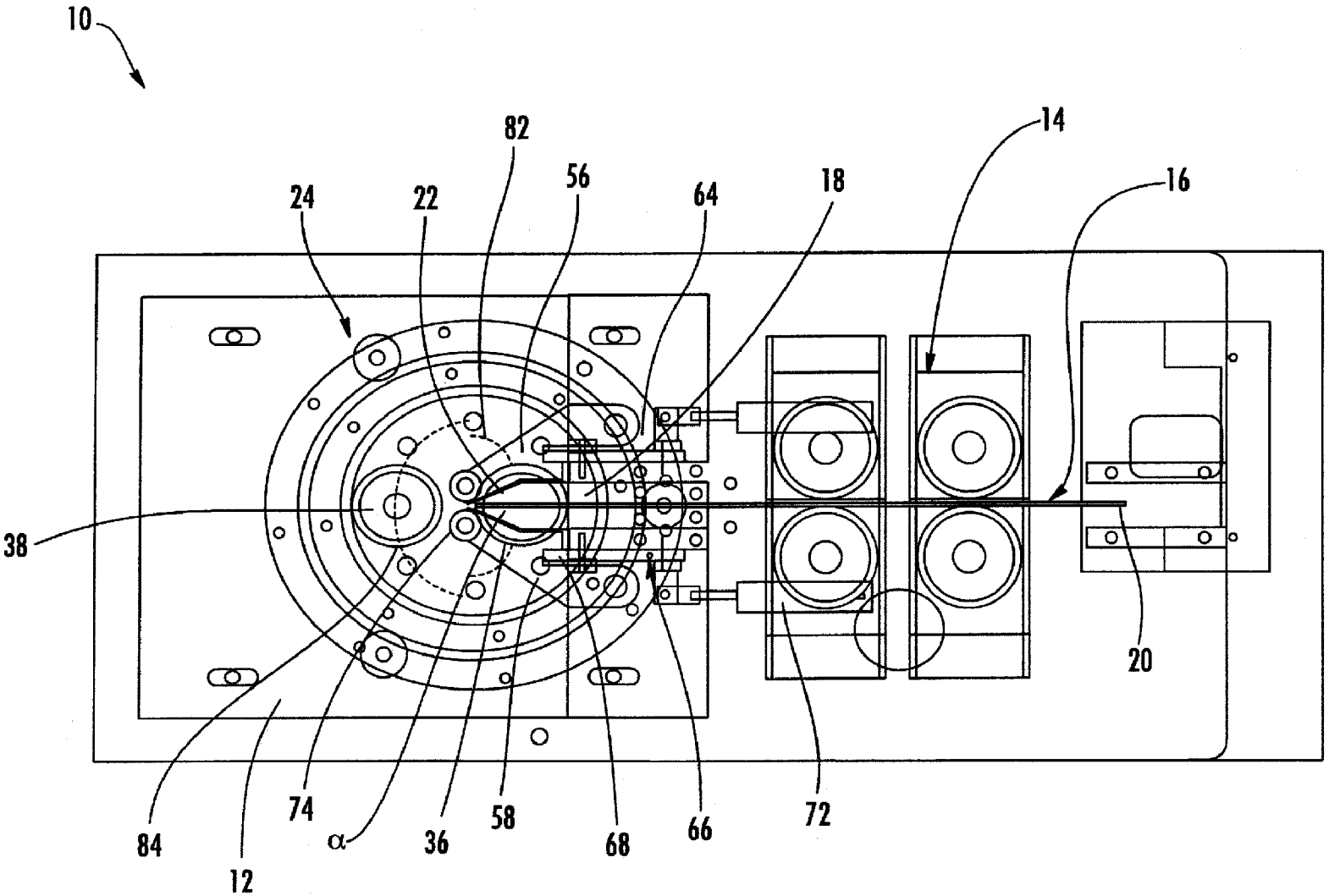
FIG. 1 is an top view of the automated bending device of the present invention.

Referring now to FIGS. 1-7, wherein like elements are numbered consistently throughout, FIG. 1 shows one embodiment of an entire bending device, as seen from above, generally referred to as 10. By way of an overview, the device 10 includes a table with a surface 12 upon which are at least two opposed drive rollers 14 rotatably connected thereto. The drive rollers 14 create a feed path 16 for a material 20 to move therebetween. A pair of holding plates 18 are located upstream of the drive rollers 14, also along the feed path 16. The holding plates 18 are orientated perpendicular to the table surface 12 and serve to maintain the strip of material 20 in a substantially perpendicular position relative to the surface of the table 12.

Each of the holding plates 18 includes a sharp bending die 25 formed at its first end. These sharp bending dies 22 serve as both a means to guide the strip of material 20 along the feed path 16 and a contact surface against which a bending assembly 24 acts to produce a "sharp" bend in the material 20. In a particularly preferred embodiment, the contact surface of each of the sharp bending dies form an acute angle, $\alpha$ with the feed path 20.

Figure 2:
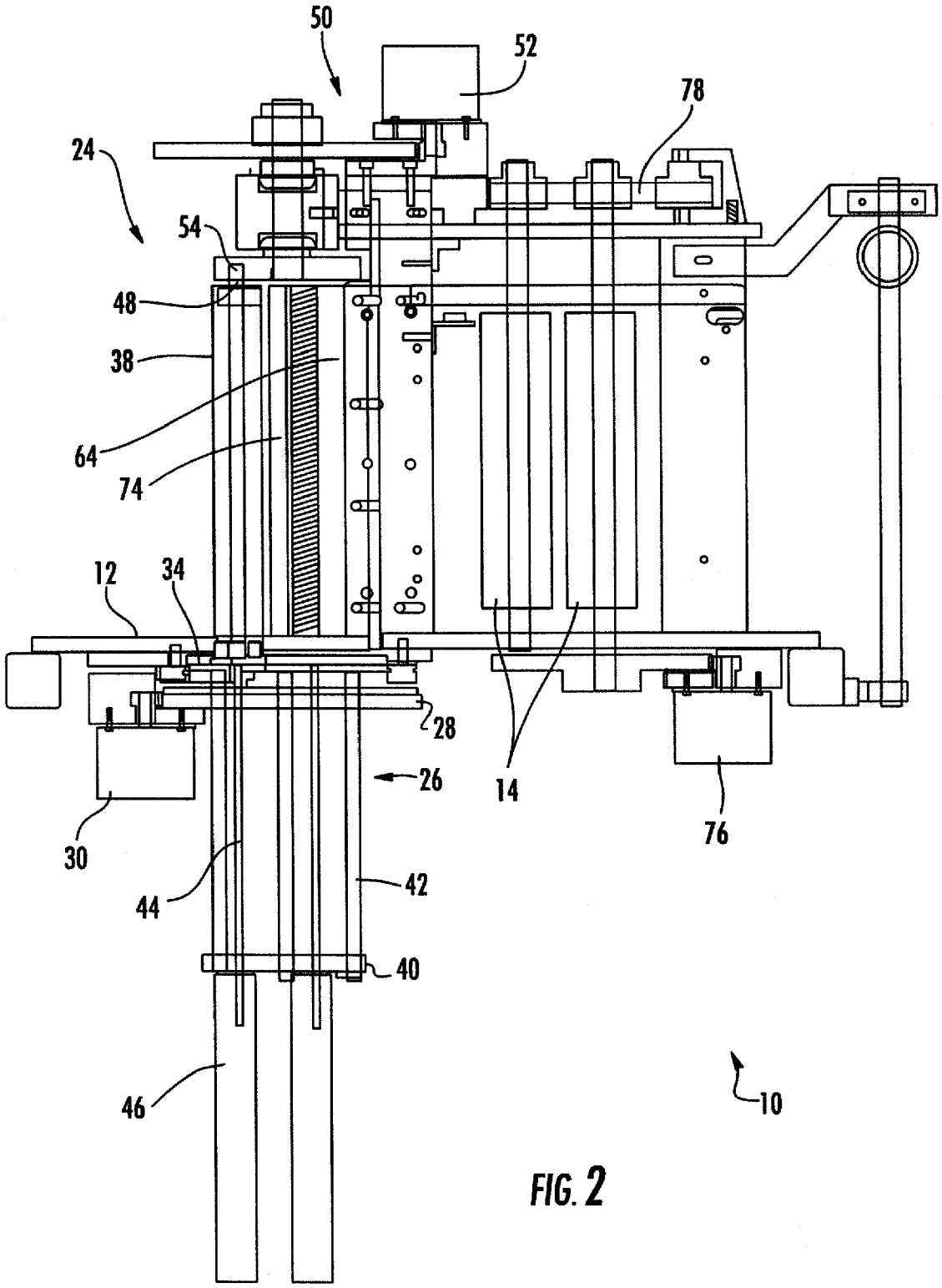
FIG. 2 is a perspective right side view of the automated bending device of the present invention.

As seen in FIG. 2, the bending assembly 24 includes a rotating assembly 26 upon which a sharp bending roller 36 and a round bending roller 38 are rotatably disposed. The rotating assembly 26 comprises a lower rotating head portion 28 that is, in turn, connected to a reversible stepper motor 30 by any means known in the art, (i.e. gears, belts, etc.). The lower rotating head portion 28 is affixed to the underside of table 12, such that it remains beneath the surface of the table, preferably with in an enclosed housing 32 so as to avoid contact with the operator of the device. The lower rotating head portion 28 further includes a rotating circular platform 34 upon which at least one sharp bending roller 36 or round bending roller 38 is positioned when in an "upper position", that is, when the roller is above the table surface 12 and in the feed path 16 of the strip of material 20.

With continued reference to FIG. 2, the rotating assembly includes a fixed platform 40, connected at one end to the bottom surface of the table by at least one support rod 42. The fixed platform 40 creates a surface upon which the sharp and round bending rollers 36, 38 reside when in their "lowered" position beneath the table 12. When in their lowered position on the fixed platform 40, the sharp and round bending rollers 36, 38 each include a ram 44 axially disposed therein. The fixed platform 40 includes apertures (not shown) through which the rams 44 located beneath the fixed platform 40 can be selectively triggered by any actuator means known in the art, shown here as fluid cylinders 46. Once actuated, the rams 44 move the round and sharp bending rollers 36, 38 to their upper position and onto rotating platform 34. After the roller 36 or 38 has been raised to its upper position a top portion 48 of the roller is releasably engaged by an upper rotating head 50, FIG. 2. This permits the ram 44 to be released form the lower end of the roller and retracted below the platform 34. When the roller 36 or 38 is to be moved to its "lowered" position below table 12, the ram 44 is raised by the actuator 46 and engages the lower end of the roller. The top portion 48 of the roller is then released from rotating head 50. The actuator 46 then lowers ram 44 and roller below the table 12. Once a roller is in its raised or "upper position" it is held in place by rotating platforms 34 and 50. These platforms permit the roller to be moved into and away from the feed path 16 of the material.

For example, when it is desired to form a rounded corner or shape on the strip of material 20, the ram actuator 46 connected to the ram 44 of the round bending roller 38 is energized and, consequently, round bending roller 38 is elevated into its upper position on the rotating platform 34. While in this position the rotating platforms 34 and 50 move the roller 38 through an arc 84 illustrated by the dotted line in FIG. 1. This action moves the roller 38 into and away from the path 16 of the material. The roller can bend the material to the left or the right of bending die 22. After the material 20 engages roller 38 the degree or distance that it is rotated away from the path 16 controls the amount or degree of the bend. The combination of the material 20 moving forward and the roller 38 rotating into and away from the path 16 forms the material into the desired shape. When a sharper corner or shape is desired the sharp bending roller 36 is used. As can be seen in FIG. 1, the sharp bending roller is located radially closer to the feed path 16 and travels through a smaller arc 82. This permits the material to be bent at a sharper angle. Whenever the bend is changed from a sharp to a round bend, the material 20 is stopped and the appropriate roller is then moved into position.

As shown in FIG. 1, the sharp and round bending rollers 36, 38 are of a generally cylindrical shape with a height that preferably corresponds to the height of the pair of holding plates 18. Moreover, the rollers 36, 38 can be of any diameter desired.

The top portion of both the sharp and round bending rollers can include at least one integrally formed connecting means 48 for releasably engaging an upper rotating head portion 50. Similar to the lower rotating head portion 28, the upper rotating head portion 50 is powered by a reversible stepper motor 52, connected thereto via any means known in the art (i.e. gears, belts, etc.). Both the lower and upper rotating head portions 28, 50 work in concert with each other to control the rotation of the rollers 36, 38, in arcs 82 and 84 respectively when in their upper position, such that they act to contribute to the overall bending force across the width of the material 20.

As illustrated in FIG. 2, the upper rotating head portion 50 is affixed at a predetermined height above the surface of the table 12 by any means known in the art and includes a receiving means 54 for receipt of the roller connecting means 48 in order to ensure the bending rollers 36, 38 remain in a substantially vertical position when in the upper position. The lower and upper rotating head portion stepper motors 30, 52 are synchronized, but in opposite directions such that the upper and lower head portions 28, 50 together drive either of the bending rollers 36, 38 in arcs 82 and 84 respectively at a predetermined rate as the material is fed along the path.

In addition, the bending assembly 24 includes a pair of independently controlled round rolling arms, a left rolling arm 56 and right rolling arm 58, both orientated perpendicular to the table surface 12 and rotatably connected at one end to thereto. These round rolling arms 56, 58 are constructed and arrange to flank either side of the pair of holding plates 18 when in a first "closed" position (FIG. 1). That is, the distal ends of each of the round rolling arms 56, 58 align on either side of, and proximate to, the upstream portion of the feed path 16, preferably, next to the sharp bending dies 22 of the holding plates 18. Each round rolling arm 56, 58 is can be independently rotated depending whether a right facing or left facing curve is desired in the material strip 20.

Figure 4:
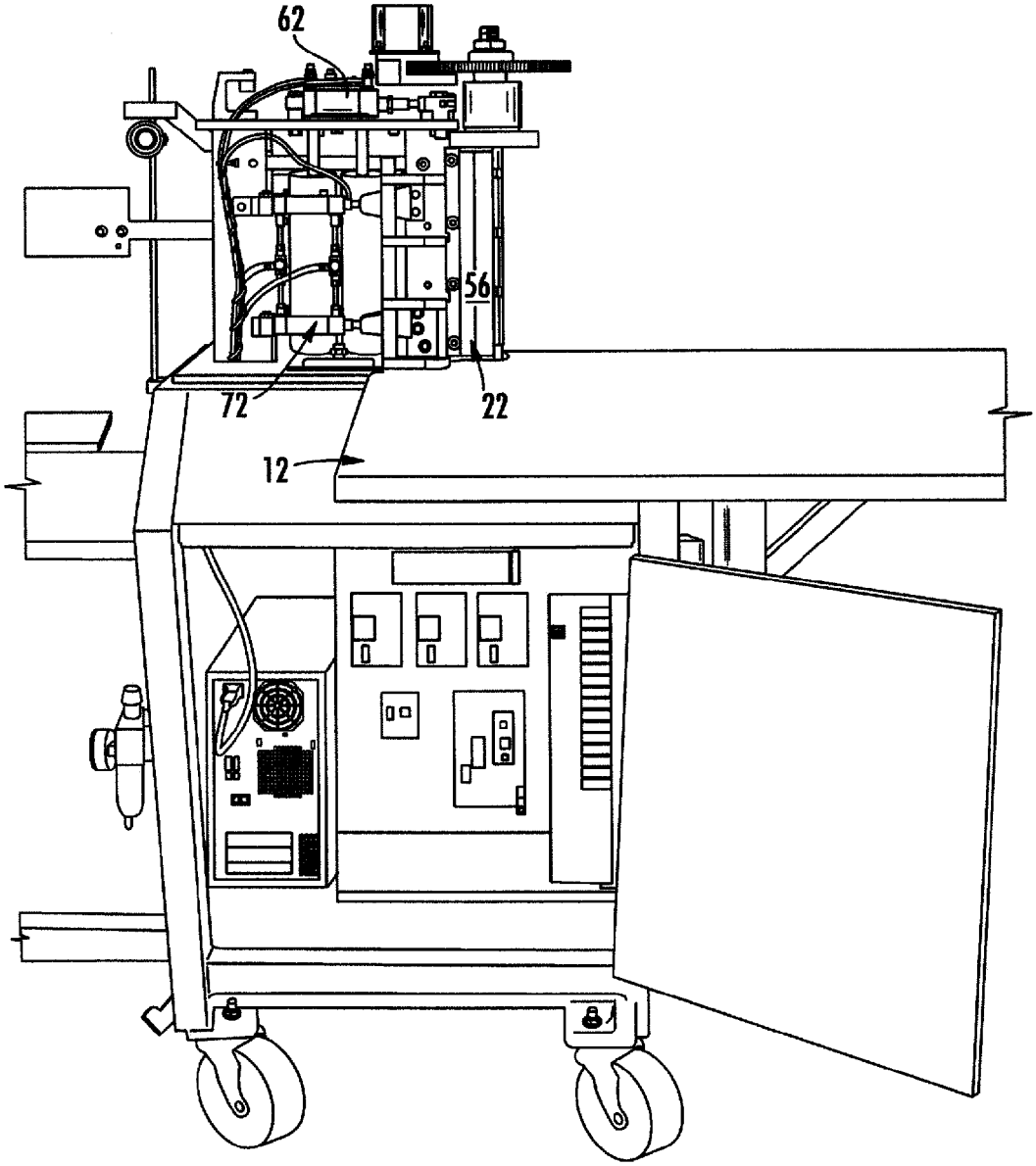
FIG. 4 is a left side view of the automated bending device of the present invention.
Figure 5:
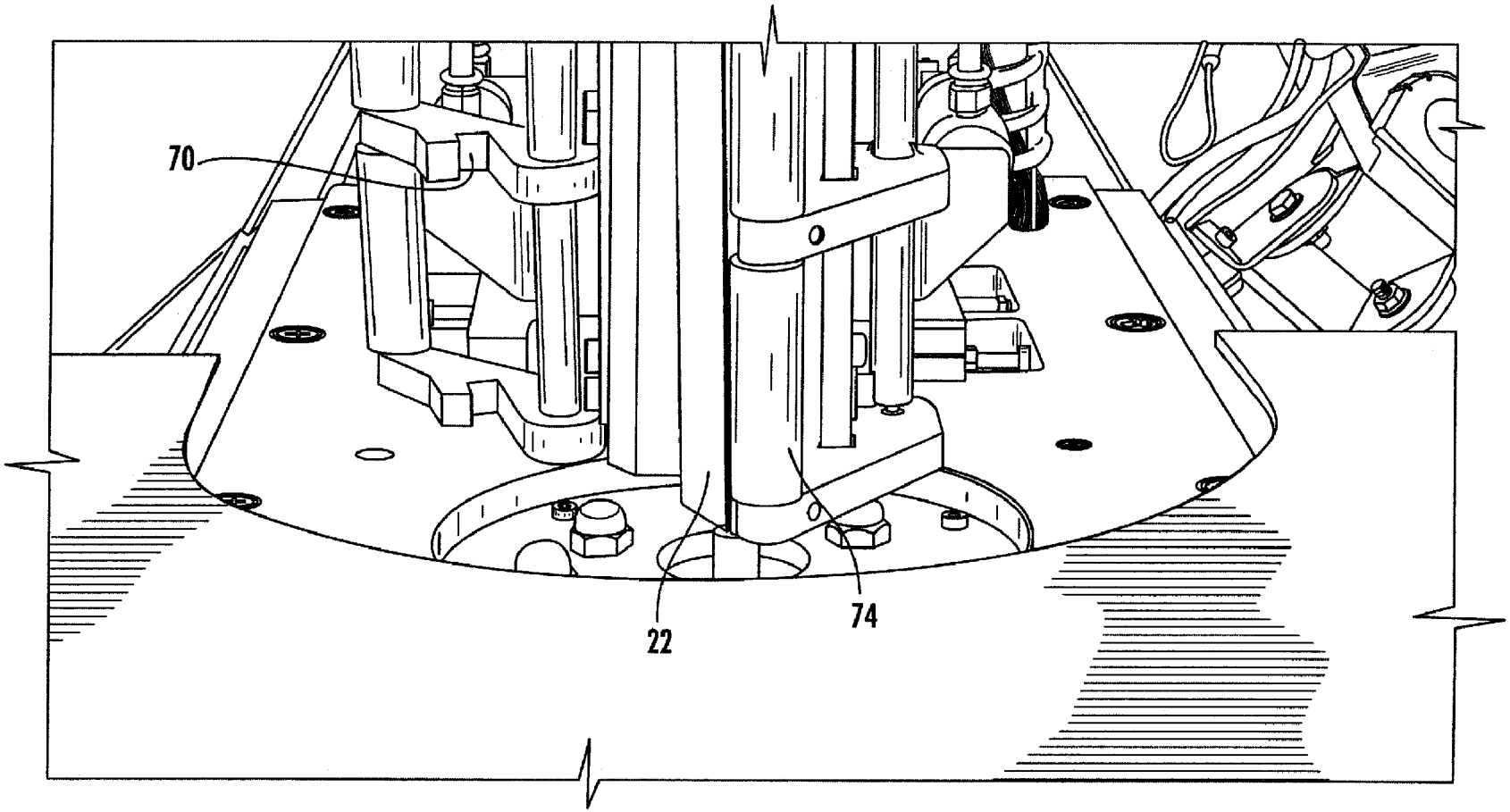
FIG. 5 is a partial, lower view of the front of the automated bending device of the present invention.
Figure 6:
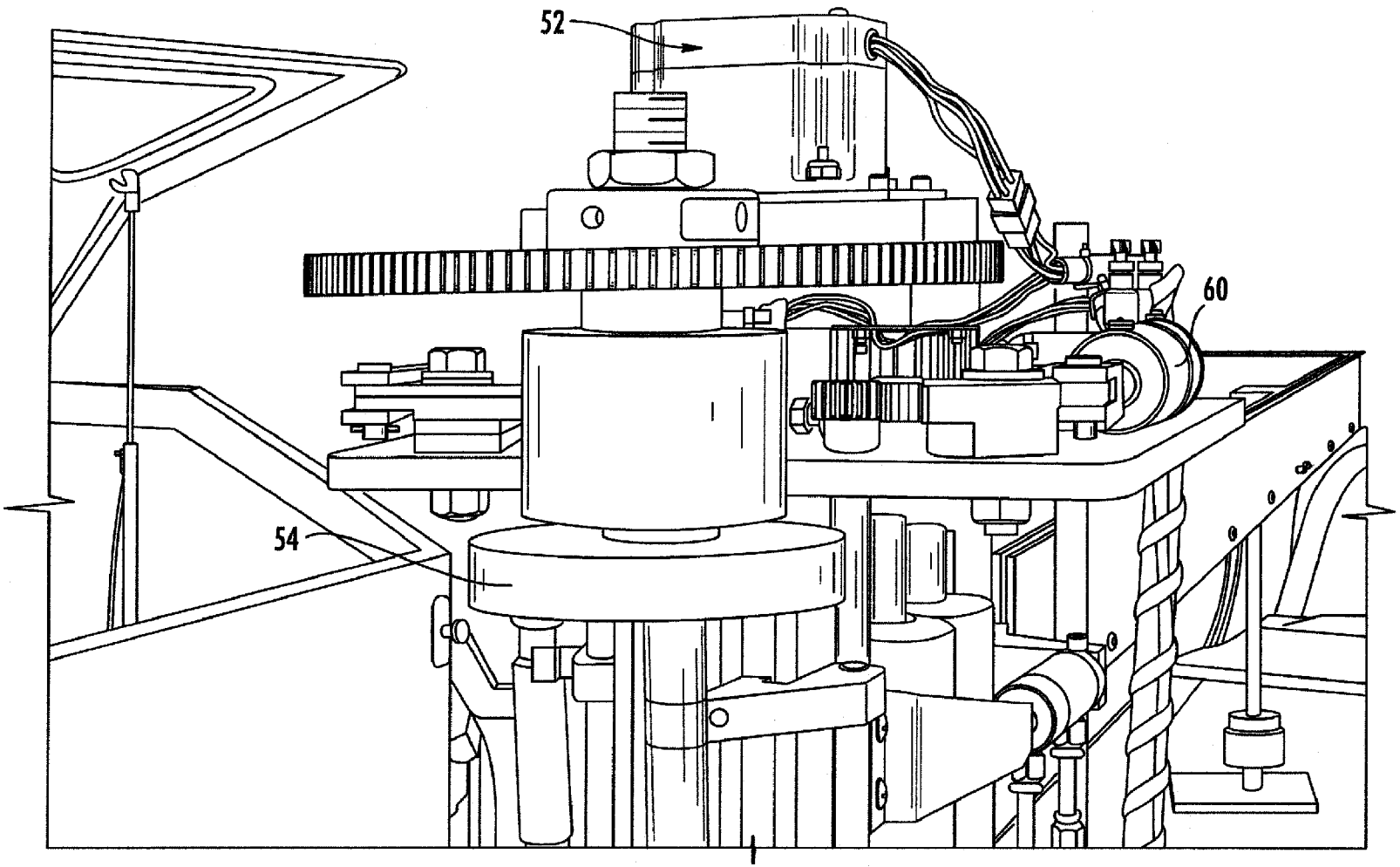
FIG. 6 is a partial, upper view of the front of the automated bending device of the present invention.
Figure 7:
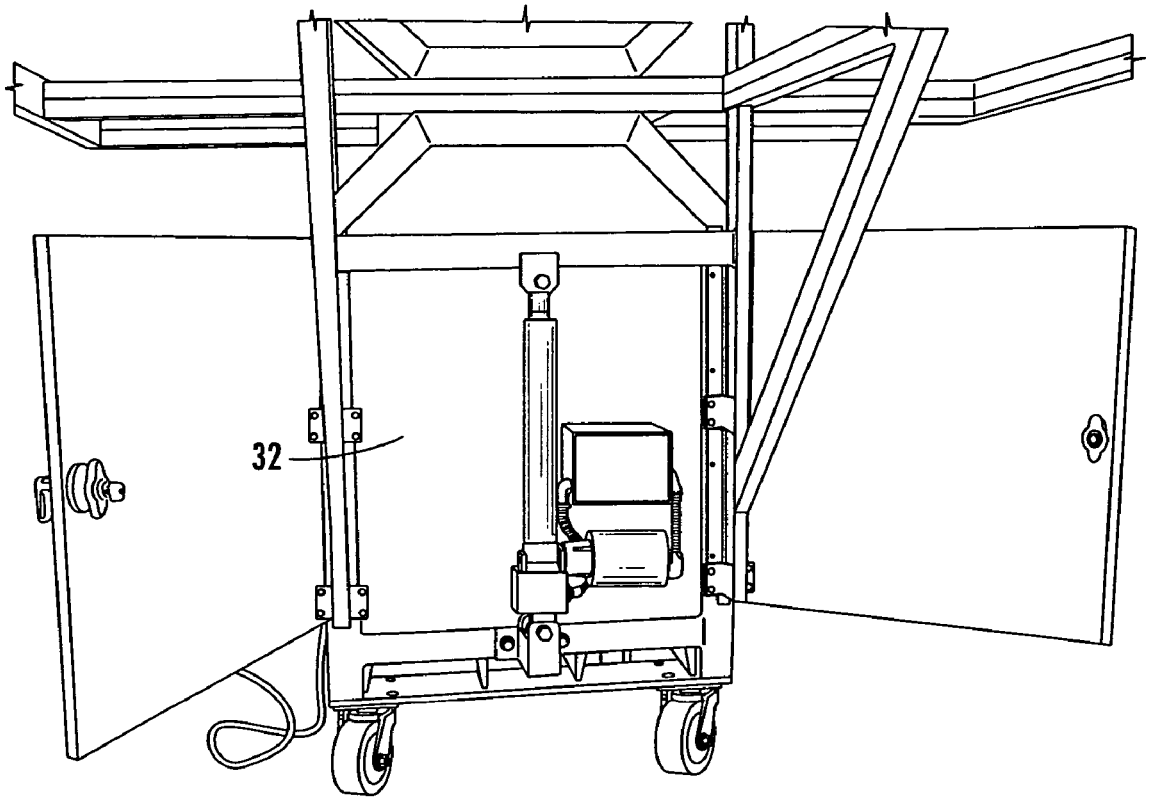
FIG. 7 is a back view of the automated bending device of the present invention.

FIGS. 4-6, show the left rolling arm 56 in the open position and the right rolling arm 58 in the closed position. It is recognized that any means to actuate each round rolling arm could be used, shown here as a pair of fluid cylinders 60, 62. Upon activation by said cylinders, each of the round rolling arms 56, 58 move in an arcuate path above the surface of the table 12 to a second fully "open" position, such that they are located substantially away from the material 20 as it is moved along the feed path 16, as shown in FIGS. 4 and 5.

Each of the round rolling arms 56, 58 are capable of being locked by left and right locking dog 64, 66 when in the closed position for enhanced reinforcement. In a preferred embodiment, the locking dogs 64, 66 comprise at least one movable wedge, or pin, 68 that will project into at least one correspondingly sized hole 70 integrally formed in the rolling arms 56, 58 that are sized for receipt of the wedge 68. It should be noted, however, that the receiving hole and wedge configuration could be reversed, or a different type of connecting arrangement used.

As seen in FIG. 1, each locking dog 64, 66 may be controlled by any means known in the art, shown herein as, albeit not limited to, a fluid cylinder 72. Thus, these locking dogs 64, 66 prevent any movement of the round rolling arms 56, 58 from its proper position as the material strip 20 is forcibly bent against it. Moreover, the distal ends of each of the round rolling arms 56, 58 can include a freely rotating rounded cylinder 74 for providing a durable contact surface upon which the strip of material can be readily bent against by rollers 36 or 38 without being damaged or marred. The rotation of rollers 36 or 38 through arcs 82 or 84 bend the material 20 around cylinder 74.

In a preferred embodiment at least two driver rollers 14 located downstream from the bending assembly 24 serve to measure and feed the material 20 through the device. In a preferred embodiment, a master drive roller is directly connected to a stepper motor 76 and the remaining slave drives are operatively connected by way of a timing belt 78 (FIG. 2). It is contemplated that other means of moving the drive roller could be used, for example, worm gears or the like. The external surfaces of the drive rollers 14 can comprise any non-slip and/or textured material for enhanced surface contact with the strip of material 20, such that the material is easily conveyed toward the bending assembly 24. Moreover, the feed path 16 can include a coating to reduce friction, thereby ensuring that the material will slide smoothly, even if the path has developed imperfections or is otherwise not planer from continued use.

The height of the table's surface can be made taller or shorter to accommodate metal strips of various heights, i.e. from about 1 inch to about 12 inches. The height of the table can be adjusted manually or by a separate actuator that is, in turn, controlled by a control means. Similarly, the distance between the pair of holding plates 18 can be adjusted to accommodate a strip of material with a thickness less than about 0.5 inch.

With the present invention virtually any desired bend can be formed at any location along the material strip 20 as it is continuously feed into the device. For example, during operation of the instant device a 90 degree bend to the left in the material is needed in response to an input from a controller 80, thus, the ram actuator 46 within the sharp bending roller 36 and the synchronous stepper motors of the lower and upper rotating head assemblies 30, 52 are activated and the sharp roller 36 is instantaneously raised onto the rotating platform 34, on the right side of the feed path and into registration with the upper rotating head portion 50, via the connecting means 48. As shown in FIG. 1, the sharp bending roller 36 is located at a position proximate the sharp bending dies 22, thus, the sharp bending roller 36 travels along a circular path, or arc, (shown as a dotted line 82) in the circular platform 34 as it is rotated.

In this example, the sharp bending roller 36 is moved along an arc and into contact with the right side of the material strip 20, as it is simultaneously and continuously fed along the feed path 16 by the driving rollers 14, such that the material 20 is forced between the cylindrical surface of the sharp roller and the left sharp bending die 22. Moreover, the sharp roller 36 can continue along its arc of travel until the desired bend angle is obtained in the material or it can be quickly moved underneath the table surface 12 to the other side of the strip of material as the material is being fed along path 16. Therefore, the sharp roller 36 is able to form the material strip into any angle that is between one perpendicular to the feed path and the angle $\alpha$ of the face of the sharp bending die 22.

Additionally, the bending assembly 24 may be used to impart a curve to the strip of material. In this example, when a curve in the material is needed in response to an input from the controller 80, the ram actuator 44 within the round bending roller 38 and the lower and upper rotating head motors 30, 52 are activated and the round roller 38 is instantaneously raised to an upper position onto the rotating platform 34 on right side of the feed path. Next, the left side round rolling arm 56 moves in response from the controller to its "closed" position, that is, the distal end of the round rolling arm 56 moves proximate to left sharp bending die 22, as shown in FIG. 1. Next, the left side round rolling arm locking dog 64 is energized such that the actuating wedge 68 projects into its slot 70 in the round rolling arm, thus, securing the left side round rolling arm 56 in the desired closed position during the bending process, see FIG. 5.

In the preferred embodiment, the round bending roller 38 is located at a radial position on the circular rotating platform 34 that is a further distance from the sharp bending dies 22 than the sharp bending roller 36 when in its upper position. In other words, the circumference of the circular path, or arc, of the round bending roller 38 is larger than that of the sharp bending roller 36 as the platform 34 is rotated. Therefore, as the round bending roller 38 is moved along its arc 84 (shown as a dotted line in FIG. 1) placed into contact with right side of the material strip 20 being simultaneously feed along the feed path 16 by the driving rollers 14, the material 20 is thereby forced between the cylindrical surface of the round bending roller 38 and the left rounded arm cylinder 74. Moreover, the rounded roller 38 can continue along its arc of travel until the desired curve in the material 20 is obtained.

Additionally, the round roller 38 can be used to create another curve on the same side of the material, moved to the fixed platform 40 underneath the table surface, or moved to the other side of the strip of material as the material is being feed through the feed path. At this point, if deemed necessary based upon a signal from the controller 80, a sharp angle can be carried out by the sharp bending roller 36 in the same manner described above.

Figure 3:
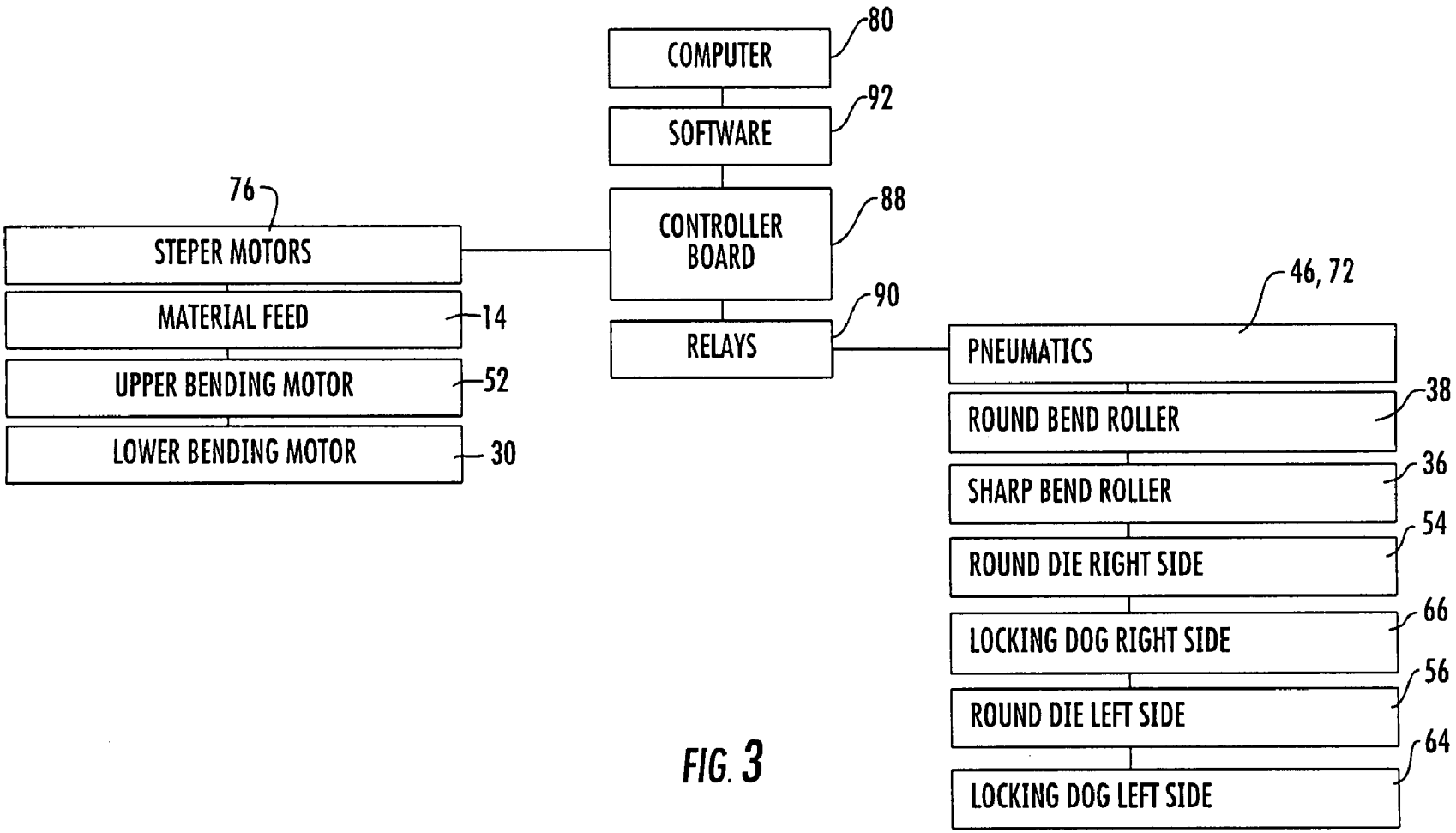
FIG. 3 is a flow chart of the operation of the automated bending device of the instant invention.

In a particularly preferred embodiment shown in the flow diagram of FIG. 3, the controller 80 is a computer, which directs the operation of the entire device. The computer may receive design information from a file containing bending information such as, the shape, size, and sequence of bends necessary to form the desired character in the material. In a preferred embodiment, the device can utilize as least one sensor (i.e. optical, electrical, mechanical, or the like) to determine that a strip of material has been placed upon the surface of the table 12 and defines a "home" position for the device. Upon activation of the device 10 by the operator, the opposed drive rollers 14 engage the strip of material 20 and guide it between the pair of holding plates 18 along the feed path toward the bending assembly 24. The location of the material strip within the device is necessary in order to correctly identify the location of the strip relative to the bending assembly 24 for generating precise and accurate bends where and when needed on the strip 20. Additional sensors may be placed along the feed path to determine where the back edges of the material strip are in relation to the bending assembly 24.

The design information regarding the desired shape of the material strip is input into the computer by any means known in the art (keyboard, scanner, disc, touch-screen, etc), preferably in an AutoCad format (i.e. DXF file). The information supplied could contain the specific locations of any notches created during the notching process, that is, where the strip of material 20 is notched along the length of the strip, thereby allowing the material to be bent without stressing or bunching the material. Typically, this design information discloses the final desired shape, style, font etc., of the character. The computer's software uses information obtained from the at least one position sensors and the design information, and transforms this information into signals that are sent to at least one electronic controller board 88. These signals are used by the electronic board 88 to control the speed and timing of all the various devices according to the design instructions, for example, the speed of the stepper motors 76, 30, 52 used to move the drive rollers 14 and/or upper and lower rotating heads. Additionally, the electronic controller board 88 transmits signals to any of the various relays 90 that may present, like those used to operate the pneumatic devices (i.e. round bend roller, sharp bend roller, round die right, round die left, locking dog right, locking dog left, etc).

The controller software 92 can include a "calibration mode" to ensure all of the tooling devices in a coordinated manner with the software 92 and determine whether any adjustment of the devices is needed. By way of illustration, the calibration mode can be used to determine whether the stepper motor 76 used to control the drive rollers 14 are properly calibrated. For example, the user can place a strip of material 20 having a known length, (i.e. 48 inches), in the feed path. Based on the feedback from a downstream sensor (i.e. position sensor) the computer will determine where a first or beginning edge of the strip is. Then, the strip is conveyed upstream along the feed path, with the bending assembly 24 inactive. Once another predetermined marker (i.e. second edge of the strip) passes by a second sensor (i.e. position sensor), the computer software 92 calculates what how many steps per inch in the stepper motor 76 correspond to 48 inches. Moreover, the software 92 can contain additional routines/subroutines to calibrate the other devices, for example, albeit not limited to, the roller assembly, round die right, round die left, locking dog right, locking dog left, etc.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. An automated strip bending device for bending a strip of metal material at predetermined locations as said strip of metal material is continuously fed though said strip bending device, said strip bending device comprising:

a table with a surface upon which at least two opposed drive rollers are rotatably connected to, said drive rollers being connected to said table, said drive rollers are constructed and arranged to drive said strip of metal material along a feed path;

at least one pair of holding plates connected to said table and located downstream said drive rollers along said feed path to maintain said strip of metal material in a substantially perpendicular direction relative to the surface of the table, said holding plates including left and right side sharp bending dies formed at their first ends to provide a contact surface that a bending assembly acts upon to produce a sharp bend on said material strip; and said bending assembly including a sharp bend roller and a round bend roller secured to a rotating assembly, said bending assembly constructed and arranged to independently position said sharp bend roller and said round bend roller on either side of and across said feed path for creating at least one sharp angle or curve at predetermined locations along said strip of material;

wherein said strip bending device is capable of creating bends or angles in said strip of material without the need to stop the advancement of said strip of material during operation of said device;

wherein said bending assembly includes a pair of independently controlled round rolling arms rotatably connected to said table surface, each said rolling arm includes a die surface upon which said round bending roller acts against to produce a curved bend as the material strip is continuously fed through said device.

2. The automated strip bending device as set forth in claim 1, wherein each of the round rolling arms are constructed and arranged to prevent any movement of said round rolling arms from their proper position as said material strip is forcibly bent against it.

* * * * *